US011600907B2

(12) United States Patent
Coles et al.

(10) Patent No.: US 11,600,907 B2
(45) Date of Patent: Mar. 7, 2023

(54) ANTENNA DESIGN IN THE BODY OF A WEARABLE DEVICE

(71) Applicant: Motorola Mobility LLC, Chicago, IL (US)

(72) Inventors: Katherine Coles, Chicago, IL (US); Michael Russell, Lake Zurich, IL (US); Robert DeGroot, Crystal Lake, IL (US); Eric Krenz, Crystal Lake, IL (US)

(73) Assignee: Motorola Mobility LLC, Chicago, IL (US)

( * ) Notice: Subject to any disclaimer, the term of this patent is extended or adjusted under 35 U.S.C. 154(b) by 0 days.

(21) Appl. No.: 17/548,561

(22) Filed: Dec. 12, 2021

(65) Prior Publication Data

US 2022/0102846 A1 Mar. 31, 2022

Related U.S. Application Data

(60) Continuation of application No. 16/866,921, filed on May 5, 2020, now Pat. No. 11,233,317, which is a division of application No. 15/369,208, filed on Dec. 5, 2016, now Pat. No. 10,700,421.

(51) Int. Cl.

| | |
|---|---|
| ***H01Q 1/27*** | (2006.01) |
| ***H01Q 9/04*** | (2006.01) |
| ***H01Q 1/22*** | (2006.01) |

(52) U.S. Cl.

CPC ..... *H01Q 1/273* (2013.01); *H01Q 1/2291* (2013.01); *H01Q 9/0421* (2013.01)

(58) Field of Classification Search

CPC ..... H01Q 1/27; H01Q 1/273; H01Q 1/2291; H01Q 9/0421

See application file for complete search history.

(56) References Cited

U.S. PATENT DOCUMENTS

| | | | |
|---|---|---|---|
| 9,478,847 | B2 | 10/2016 | Russell et al. |
| 10,700,421 | B2 | 6/2020 | Coles et al. |
| 11,233,317 | B2 | 1/2022 | Coles et al. |
| 2012/0274508 | A1 | 11/2012 | Brown et al. |
| 2014/0240181 | A1 | 8/2014 | Mamuro et al. |
| 2014/0253393 | A1 | 9/2014 | Nissinen et al. |

(Continued)

OTHER PUBLICATIONS

"Final Office Action", U.S. Appl. No. 15/369,208, dated Jun. 28, 2019, 15 pages.

(Continued)

*Primary Examiner* — Hoang V Nguyen
(74) *Attorney, Agent, or Firm* — FIG. 1 Patents

(57) ABSTRACT

A portable computing device includes an antenna within its housing structure for wireless connectivity, where an upper partition of the housing structure is used to construct an antenna plane, and a ground plane is incorporated into a lower partition of the housing structure. In some cases, the antenna is capable of maintaining wireless connectivity over a wide frequency band. Some embodiments include a device mount external to the upper partition and the lower partition of the housing structure that enables mounting the portable computing device to another entity, such as a user. In some cases, the device mount is external to the antenna used by the portable computing device, and does not include any portions of the antenna.

20 Claims, 6 Drawing Sheets

(56) References Cited

U.S. PATENT DOCUMENTS

| | | | | |
|---|---|---|---|---|
| 2014/0266939 | A1 | 9/2014 | Baringer et al. | |
| 2014/0354494 | A1* | 12/2014 | Katz | H01Q 1/273 343/718 |
| 2015/0255855 | A1 | 9/2015 | Tsai et al. | |
| 2016/0261032 | A1 | 9/2016 | Chang et al. | |
| 2018/0090826 | A1 | 3/2018 | Da Costa Bras Lima et al. | |
| 2018/0159206 | A1 | 6/2018 | Coles et al. | |
| 2020/0266530 | A1 | 8/2020 | Coles et al. | |

OTHER PUBLICATIONS

"Non-Final Office Action", U.S. Appl. No. 15/369,208, dated Dec. 27, 2018, 12 pages.
"Non-Final Office Action", U.S. Appl. No. 15/369,208, dated Dec. 2, 2019, 15 pages.
"Non-Final Office Action", U.S. Appl. No. 16/866,921, dated May 17, 2021, 9 pages.
"Notice of Allowance", U.S. Appl. No. 15/369,208, dated Mar. 17, 2020, 10 pages.
"Notice of Allowance", U.S. Appl. No. 16/866,921, dated Oct. 14, 2021, 8 pages.
"Restriction Requirement", U.S. Appl. No. 15/369,208, dated Oct. 2, 2018, 7 pages.

* cited by examiner

ANTENNA DESIGN IN THE BODY OF A WEARABLE DEVICE

RELATED APPLICATIONS

This application is a continuation of and claims priority to U.S. patent application Ser. No. 16/866,921 filed May 5, 2020 entitled "Antenna Design in the Body of a Wearable Device," the disclosure of which is incorporated by reference herein in its entirety. The U.S. patent application Ser. No. 16/866,921 is a divisional of and claims priority to U.S. patent application Ser. No. 15/369,208 filed Dec. 5, 2016 entitled "Antenna Design in the Body of a Wearable Device," the disclosure of which is incorporated by reference herein in its entirety.

BACKGROUND

Over time, advancements in technology have produced smaller devices with increased functionality, such as wireless connectivity. As devices decrease in size, their portability increases. Thus, smaller devices with wireless connectivity allow users to easily move the devices from place to place while remaining in contact with a corresponding wireless network. However, these smaller forms can pose challenges for reliability when it comes to wireless connectivity. More particularly, the physical constraints of these smaller forms can affect how efficiently a corresponding antenna radiates wireless signals which, in turn, impacts the smaller devices' ability to maintain a wireless connection.

BRIEF DESCRIPTION OF THE SEVERAL VIEWS OF THE DRAWINGS

While the appended claims set forth the features of the present techniques with particularity, these techniques, together with their objects and advantages, may be best understood from the following detailed description taken in conjunction with the accompanying drawings of which:

DETAILED DESCRIPTION

Figure 1:
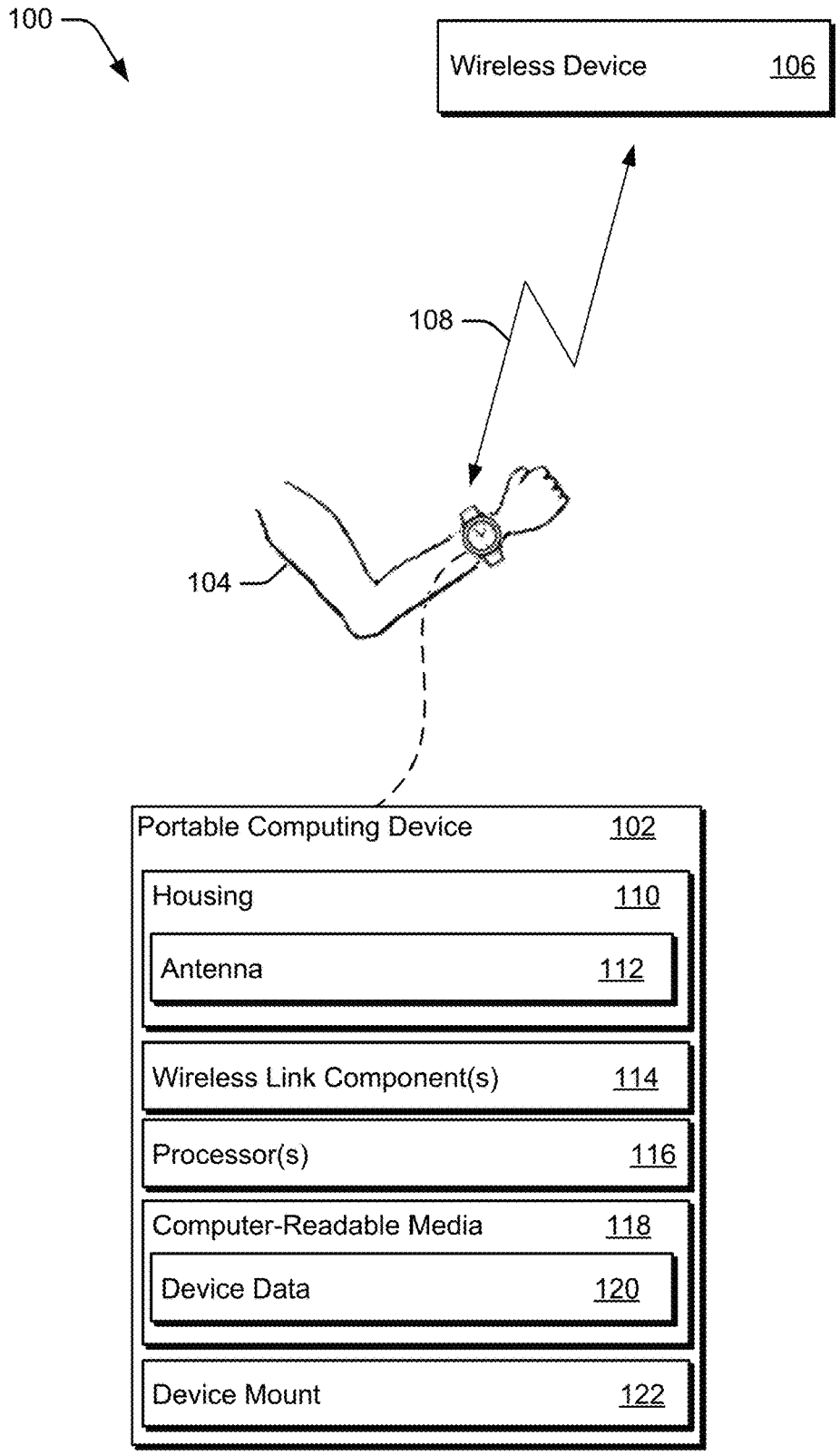
FIG. 1 is an overview of a representative environment that includes an example implementation in accordance with one or more embodiments.

Turning to the drawings, wherein like reference numerals refer to like elements, techniques of the present disclosure are illustrated as being implemented in a suitable environment. The following description is based on embodiments of the claims and should not be taken as limiting the claims with regard to alternative embodiments that are not explicitly described herein.

Portable devices with wireless connectivity allow a user to access a wireless network, and any corresponding functionality associated with the wireless network, from a myriad of locations. In some cases, a user can wear or attach the portable device to their person, thus making the device easier to transport. As one example, a portable device with wireless connectivity can be configured as a wearable watch that mounts to a user via a wristband. These wearable devices provide additional reassurance to the user that the device, and the wireless access it provides, is always present and accessible. However, a portable device operating in this capacity (e.g., small enough to be portable and attached to a user) can have extra challenges associated with maintaining a wireless link. For instance, an antenna for such a device has the additional constraints of fitting into a device size that is acceptable to a user while still maintaining a radiation pattern with enough strength and shape to preserve a wireless link when worn by a user.

The embodiments described herein provide a portable system with wireless connectivity. A portable computing device includes an antenna within its housing structure for wireless connectivity, where an upper partition of the housing structure is used to construct an antenna plane, and a ground plane is incorporated into a lower partition of the housing structure. In some cases, the antenna is capable of maintaining wireless connectivity over a wide band of frequencies, such as a frequency band that ranges from 700 Megahertz (MHz) to 2700 MHz. Some embodiments include a device mount external to the housing structure that enables mounting the portable computing device to another entity, such as a user. In some embodiments, the device mount is external to the antenna used by the portable computing device, and does not include any portions of the antenna.

Consider now an example environment in which various embodiments can be employed.

Example Environment

FIG. 1 illustrates an example operating environment 100 in accordance with one or more embodiments. Operating environment 100 includes a portable computing device 102 worn on the wrist of user 104. In this example, portable computing device 102 takes the form of a wrist-wearable watch (e.g., wristwatch), but it is to be appreciated that portable computing device 102 can be implemented in any other suitable manner. Among other things, portable computing device 102 connects to wireless device 106 via wireless link 108. Here, wireless device 106 and wireless link 108 generically represent any suitable device that portable computing device 102 can connect to using any suitable wireless signal and/or protocol. For example, wireless device 106 can be a cellular base station, a wireless access point, another portable computing device, a fixed computing device, and so forth. Similarly, wireless link 108 can be a Bluetooth™ wireless link, a cellular wireless link (General Packet Radio Service (GPRS), Global System for Mobile Communications (GSM), Code Division Multiple Access (CDMA), Long-Term Evolution (LTE), Wideband Code Division Multiple Access (WCDMA), Mobile Worldwide Interoperability for Microwave Access (Mobile WiMAX), etc.), a wireless local area network link (WLAN or Wi-Fi), and so forth. In some embodiments, portable computing device 102 supports multiple different wireless links that span several different frequency bands. Thus, at times, wireless link 108 represents multiple wireless links.

Portable computing device 102 includes housing structure 110, which generally represents a housing structure or chassis that encloses the various hardware and software components that make up the portable computing device. Housing structure 110 can be made of any suitable type and combinations of material, such as a metal, a polymer, a composite, a ceramic, etc. In some cases, an upper housing portion of the housing structure can be made of a first material, and a lower portion of the housing structure can be made of a second material. Housing structure 110 generally includes an antenna 112, which is used to radiate and receive electromagnetic waves that enable portable computing device 102 to communicate to wireless device 106 over wireless link 108. Antenna 112 can be configured to radiate and receive signals over any suitable frequency range, such as frequency range that generally covers an Ultra-Low band to a High Band frequency (e.g., 700-2700 MHz). Here, the term "generally" is used to indicate a frequency range over which antenna 112 radiates and receives frequencies successfully enough to recover information contained within the frequencies. This can include real-world deviations from these frequencies that allow for alternate frequencies that are not exactly these values. In some cases, the physical construction of antenna 112 uses part or all of housing structure 110. For example, in at least one embodiment, antenna 112 uses housing structure 110 to form a Planar Inverted-F Antenna (PIFA), as further described below.

Portable computing device 102 includes wireless link component(s) 114 that generally represents hardware and/or software components configured to maintain a wireless link (e.g., wireless protocols, configure signals to send information over wireless link 108 via antenna 112, decode signals to extract information received over wireless link 108 via antenna 112, etc.) For example, wireless link component(s) 114 can include any combination of protocol stacks, receive paths, transmit paths, modulators, demodulators, an analog-to-digital converter (ADC), a digital-to-analog converter (DAC), and so forth. Wireless link component(s) 114 can be partially or fully enclosed in housing structure 110.

Portable computing device 102 also includes processor(s) 116. Processor(s) 116 can be configured as a single or multi-core processor capable of enabling various functionalities of the portable computing device. In some cases, processor(s) 116 includes a digital-signal processing subsystem for processing various signals/data that are captured or generated by wireless link component(s) 114. Processor (s) 116 can be coupled with, and may implement functionalities of, any other components or modules of portable computing device 102 that are described herein.

Portable computing device 102 includes computer-readable media 118, which stores device data 120. Here, device data 120 represents various types of data stored on computer-readable media 118, and ranges from executable code used to drive processor(s) 116, to stored values. Thus, device data 120 can include an operating system, firmware, applications, contact information, and so forth.

Portable computing device 102 also includes device mount 122. Device mount 122 represents a mechanism that enables a user to mount portable computing device 102 to their person or other object. In this example, device mount 122 takes on the form of a wristband. The wristband can be constructed of any suitable type of material, such as leather, nylon, silicon, etc. In some cases, a wristband can be constructed using a metal when the connection points between the wristband and other portions of the portable computing device are properly isolated (electrically) from one another. While device mount 122 is discussed in the form of a wristband, any other suitable mounting component can be used, such as an arm sleeve, a necklace or chain, a lanyard, a suction cup, a safety-pin fastener, a pin-and-cap mechanism, and so forth. For simplicity's sake, portable computing device 102 includes device mount 122. However, in other embodiments, device mount 122 is considered as an external component relative to portable computing device 102, and is sometimes optional. Alternately or additionally, device mount 122 is a removable component of portable computing device 102, in that removing the device mount does not affect the operation of portable computing device 102.

Generally, any of the functions described herein can be implemented using software, firmware, hardware (e.g., fixed logic circuitry), manual processing, or a combination of these implementations. The terms "module," "functionality," "component", and "logic" as used herein generally represent software, firmware, hardware, or a combination thereof. In the case of a software implementation, the module, functionality, component, or logic represents program code that performs specified tasks when executed on or by a processor (e.g., one or more Central Processing Units (CPUs)). The program code can be stored in one or more computer readable memory devices.

Having described an example operating environment in which various embodiments can be utilized, consider now a discussion of a portable computing device with wireless connectivity, in accordance with one or more embodiments.

Antenna Configuration for a Portable Computing Device

Computing devices today often times include wireless capabilities to connect with other devices. To communicate information back and forth, the computing devices establish a wireless link that conforms to predefined protocol and frequency standards. A wireless link can be more powerful than a wired link in that it provides more freedom to the connecting devices. A device can connect wirelessly to any recipient device that supports a same wireless link format without using any additional peripheral components or devices, with the added benefit of mobility. However, a wireless link is only as useful as it is reliable. For example, an unreliable or weak wireless link can lead to a higher percentage of faulty data transfers when compared to a stable and reliable wireless link. Choosing the proper antenna for a computing device can improve the reliability of its wireless link.

Consider again the above example of FIG. 1, where a portable computing device establishes a wireless link with another device. To maintain wireless link 108, portable computing device 102 uses antenna 112 to propagate and receive wireless signals. Being a form of electromagnetic radiation, the wireless signals propagated between the respective devices adhere to various wave properties, such as reflection, refraction, scattering, absorption, polarization, etc. Thus, the environment in which an antenna operates can affect the efficiency of how the antenna propagates and receives wireless signals. Accordingly, using a design based upon an expected operating environment improves an antenna's efficiency. For instance, in the case of portable computing device 102, the expected operating environment of antenna 112 includes an environment that changes location regularly, and has a close proximity to a user's person.

One type of antenna design is a dipole antenna. A dipole antenna consists of two conductive components that are usually symmetrical in length. In a half-wave dipole antenna, each pole has length of $$\frac{\lambda}{4},$$

where λ represents a tree-space wavelength corresponding to a frequency at which the dipole antenna is resonant. When an antenna is resonant, waves of current and voltage traveling between the arms of the antenna create a standing wave. Further, the antenna has its lowest imaginary component of the impedance at its resonant frequency, thus simplifying impedance matching between the antenna and transmission lines for transmission or reception. In turn, this condition tends to maximize both the radiation efficiency of the antenna, and the effective transfer of power to/from the antenna from/to its associated transceiver relative to other frequencies. Hence, a half-wave dipole antenna is a type of canonical reference antenna which is considered ideal for applications like mobile wireless connectivity. Accordingly, an antenna's resonant frequency can be controlled by various types of adjustments to the antenna length, radius, and so forth. In some cases, the length of each pole of a half-wave dipole antenna may be slightly adjusted from exactly $$\frac{\lambda}{4}$$

to account for real worm implementations, target resonant frequencies, etc. It is to be appreciated by one skilled in the art that the above discussion has been simplified, and is not intended to describe all technical aspects of antenna design.

When considering a dipole antenna in the context of a portable computing device, such as portable computing device 102 of FIG. 1, some issues arise. When vertical, a dipole antenna ideally radiates an omnidirectional pattern which yields comprehensive coverage, but in real-world applications the radiation pattern may deviate from the ideal pattern. However, a vertical antenna protruding out of a computing device worn by a user is less desirable, since it extends the size and form factor of the portable computing device, and is more susceptible to being caught on other objects or breaking. An alternative to a vertical and protruding antenna is incorporating the antenna into the device mount, such as the wristband as described with reference to FIG. 1. This can also be undesirable to the user, as it couples operations of the portable computing device to the device mount, and further constrains the user's flexibility to that particular device mount.

An alternative to incorporating an antenna into the device mount is to locate the antenna within a housing structure of the computing device itself, and decouple the antenna from the device mount. In turn, this allows a user to remove the device mount without affecting operation of the computing device. This can be achieved in any suitable manner. For instance, an Inverted-F antenna, which is a variation of a monopole antenna, is a type of antenna configured to lie horizontal. As indicated by its name, a monopole antenna consists of a single antenna pole fed against a ground plane instead of a second pole as seen in the two-pole implementation of a dipole antenna. An advantage the monopole antenna has over the dipole antenna is a reduced physical size for a same resonant frequency. To implement an Inverted-F antenna, the single antenna pole folds down from a vertical position to lie horizontal and parallel to ground. The antenna pole is shorted to ground at a first location, with the feed to the antenna pole being placed at a second location. Careful selection of the first location of the short to ground, and the second location of the feed, impacts various parameters of the antenna, such as capacitance and/or input impedance.

A Planar Inverted-F Antenna (PIFA) is a variation of an Inverted-F antenna that replaces the antenna pole with an antenna plane. Generally speaking, the resonant frequency and frequency bandwidth associated with a PIFA can be determined or managed through the size, shape, length, and/or relative spacing of the corresponding ground plane and antenna plane, as well as the location and dimensions of the shortening pin. One characteristic of a PIFA is that it is resonant at a physical dimension of a nominal quarter-wavelength $$\left(\text{e.g., } \frac{\lambda}{4}\right)$$

or less, based on consideration that it is a type of monopole with additional electrical loading via the shorting pin. Thus, as in the above case of the Inverted-F antenna, a PIFA has a more compact size than a dipole antenna, and can be useful when incorporated into a portable computing device. In some embodiments, all or part of a PIFA can be built into the housing of a device, such as housing structure 110 of FIG. 1.

Figure 2:
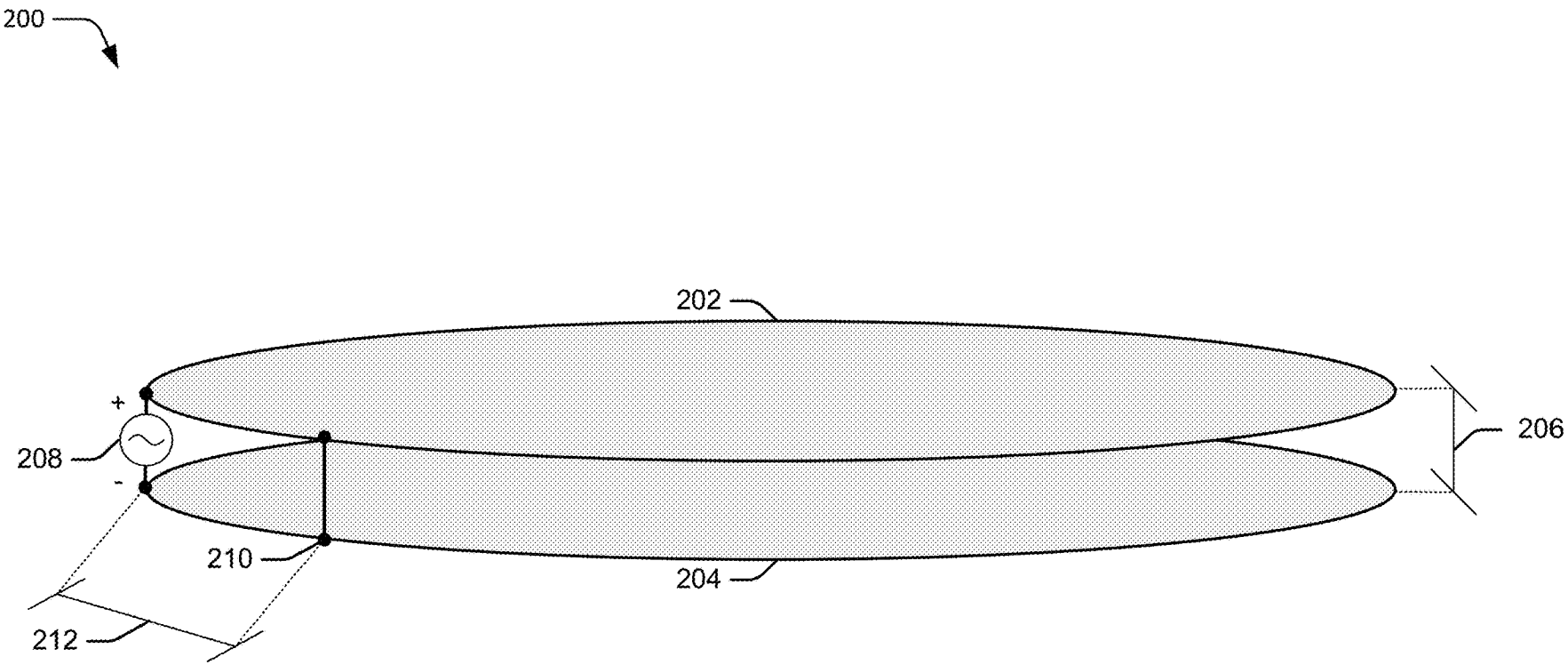
FIG. 2 illustrates an example antenna in accordance with one or more embodiments.

Consider FIG. 2, which illustrates a simplified model of a PIFA, generally indicated here as antenna 200. As one skilled in the art will appreciate, the corresponding discussion is intended to aid in the understanding of various embodiments, and is not intended describe all technical aspects of a PIFA.

Antenna 200 consists of antenna plane 202 and ground plane 204. Here, antenna plane 202 and ground plane 204 are positioned generally parallel to one another. The term "generally" is used to signify that, while ideally antenna plane 202 and ground plane 204 should be oriented ideally parallel to one another, real world conditions allow for antenna orientations that deviate from being ideally parallel, but still sustain a standing wave and/or maintain successful operation of wireless communications. However, any other suitable shape can be utilized, such as a rectangular shape, a square shape, a circular shape, a triangular shape, and so forth. The shape of antenna plane 202 or ground plane 204 can be disproportionate, such as a shape that includes prongs, tines, or fingers that extend out. Some embodiments use a smooth plane surface, in which the corresponding surface has been sealed, or cracks have been electrically shorted together, to close surface gaps and/or create a solid surface, as further described below. In other embodiments, the planes include holes or vents, include etching on a corresponding surface, include prongs or tines that extend out, and so forth. In some embodiments, the shape of antenna plane 202 differs from the shape of ground plane 204, while in other cases, the planes are uniform in shape. Antenna plane 202 and ground plane 204 can also have different sizes relative to one another. For example, ground plane 204 can have a larger size relative to antenna plane 202. The variation in size and shape of antenna plane 202 and ground plane 204, whether individually or relative to one another, can be chosen based upon an overall target range of operational frequencies, a target frequency bandwidth, or a target resonant frequency of the resultant antenna. As in the case above, the phrases "target range of operational frequencies", "target frequency bandwidth" and "target resonant frequency" are used to indicate frequency bandwidths/ranges and resonant frequencies at which the corresponding antenna radiates (or receives) more efficiently relative to other frequency bandwidths and frequencies and/or frequencies at which the antenna is operable.

The positioning of antenna plane 202 and ground plane 204 to one another includes a spacing between the planes, indicated here as gap 206. Having this gap allows a potential (voltage) difference to exist between the planes, thus causing antenna 200 to radiate. The dimensions of antenna plane 202 and ground plane 204, the spacing of gap 206, and the location and dimension of a feed source (illustrated as feed connection 208) and a shorting pin (illustrated as ground connection 210) determine the electrical performance of antenna 200. In general terms, these factors determine a frequency of resonance where antenna 200 radiates more efficiently relative to other frequencies, and energy is maximally coupled to it from the associated transceiver, relative to other frequencies. Among other things, the height of the gap 206 influences the frequency bandwidth of efficient operation and, to some extent, the radiation efficiency in a corresponding bandwidth. Gap 206 can be empty (e.g., an air gap) or can alternately include a low-loss dielectric spacer for additional support between the planes and/or to provide a controlled spatial gap between the planes. In the case of antenna 200 including a low-loss dielectric in gap 206, the dielectric constant of the corresponding material can also affect the operational frequencies of the antenna.

Antenna plane 202 and ground plane 204 are electrically connected through feed connection 208 and ground connection 210. Feed connection 208 drives antenna plane 202 with the signal to be radiated, while ground connection 210 acts as an electrical short. These two connections have a relative positioning between them, generally indicated as length 212. As discussed above, the relative positioning between feed connection 208 and ground connection 210 influences various characteristics of antenna 200, such as its input impedance, which can additionally affect operation of the antenna (e.g., target resonant frequencies, operational frequency bandwidth, etc.). Accordingly, the resonant frequencies of antenna 200 can be influenced by multiple parameters, as further described above and below.

Figure 3:
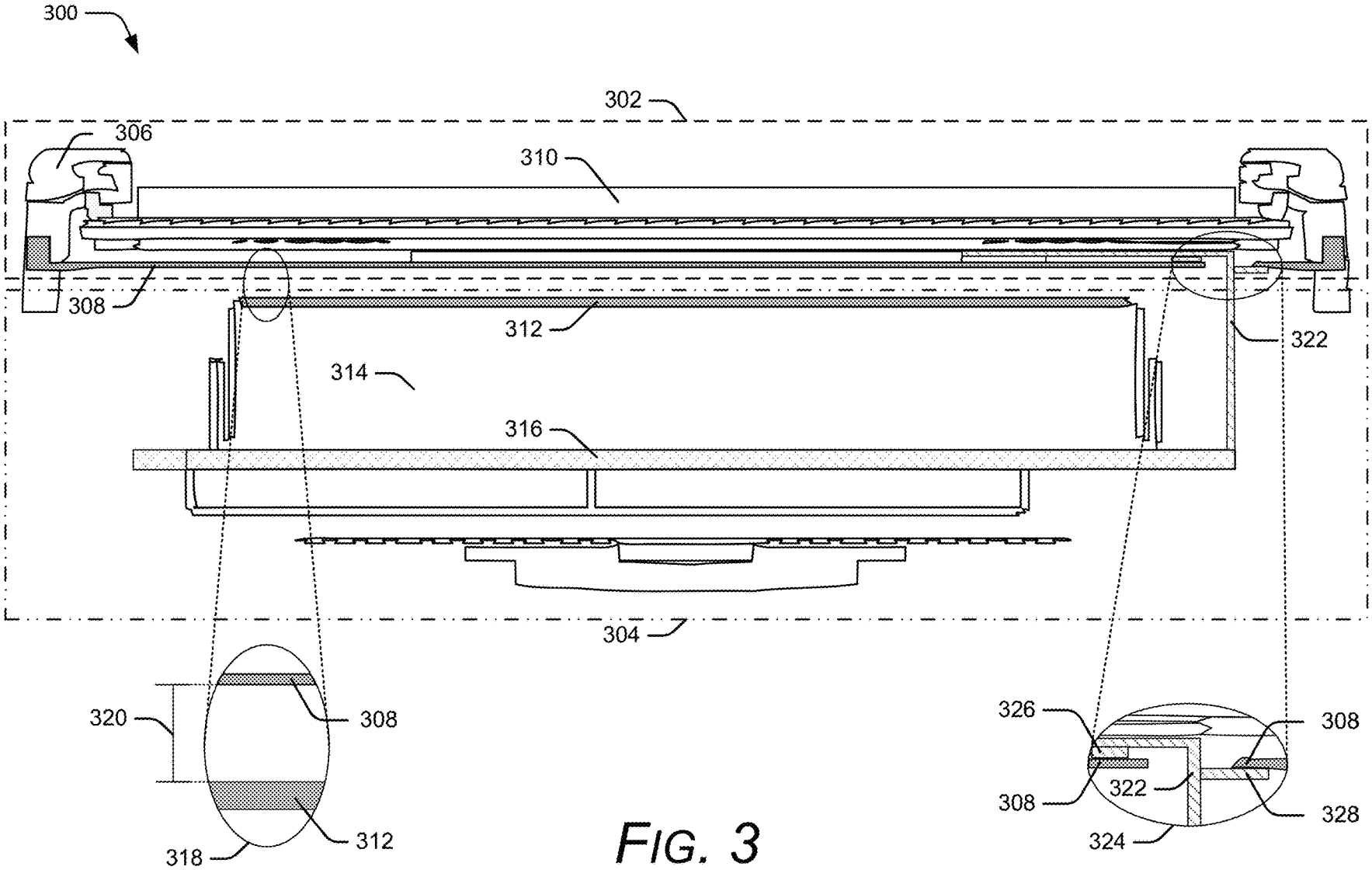
FIG. 3 illustrates an example computing device in accordance with one or more embodiments.

In some embodiments, a portable computing device incorporates an antenna for wireless connectivity by employing a PIFA using its housing and/or components partially or fully enclosed within the housing. Consider FIG. 3, which illustrates a cross-section view of computing device 300. For the purposes of this discussion, computing device 300 is illustrated as a wristwatch that a user can wear or mount onto their person. However, it is to be appreciated that portable computing device 300 can be implemented as any other suitable computing device without departing from the scope of the claimed subject matter.

Computing device 300 generally has two separate sections: upper partition 302 and lower partition 304. Among other things, upper partition 302 includes a front housing structure 306 and antenna plane 308 (shaded here in grey). Rather than having a separate antenna component, computing device 300 uses portions of front housing structure 306 to construct antenna plane 308. In some cases, antenna plane 308 is created by combining additional components with front housing structure. For example, upper partition 302 also includes display component 310, which can include any combination of components associated with a device display, such as a display assembly, a display bezel, glass, a touch screen, a display element, flexes containing electrical routing, discrete electrical components to support display operation, an NFC coil, a ferrite, and so forth. Some embodiment leverage and combine a flat metal surface of a display bezel contained within display component 310 with the front housing structure to form an antenna plane.

Consider antenna plane 202 of FIG. 2. which is illustrated as having a darker outer ring in black, and an inner flat surface shaded in grey. Following this model, some embodiments construct antenna plane 308 using front housing structure 306 as an outer structure (such as a ring or oval), and a metal bottom surface of the display bezel as the inner surface. The outer (ring) structure is electrically joined to the metal surface to create antenna plane 308 from inherent components contained within upper partition 302, rather than incorporating a separate and distinct antenna. How and where front housing structure 306 connects with the display bezel also impacts the resonant frequencies of resultant antenna plane 308, as further described below.

Lower partition 304 includes ground plane 312 (shaded in solid grey), battery 314 and Printed Circuit Board (PCB) 316 (shaded with a dotted pattern). Battery 314 provides electrical power to computing device 300, while PCB 316 contains components that, in combination, implement various functionality and/or features of computing device 300, such as a clock source, memory storage for software applications, timekeeping, programmable logic, wireless link capabilities, and so forth. Battery 314 has an electrical connection into PCB 316 as a way to transfer power. One or both of these components can additionally include an isolating element that prevents any other electrical contacts between the two. For example, the compact nature of how the components are arranged within lower partition 304 situates battery 314 on top of PCB 316. An insulator positioned between the battery and the PCB allows the two components to fit within lower partition 304 and prevents any unintended electrical contact.

Ground plane 312 generally represents a shared ground across computing device 300. Here, ground plane 312 is illustrated as a rectangular box on top of battery 314 to further emphasize its relative positioning to antenna plane 308. In some embodiments, various components within the lower partition inherently construct the ground plane. For instance, ground plane 312 can be inherently constructed from various components by keeping all metal portions of lower partition 304, or of metal components enclosed within lower partition 304, below a top surface of battery 314. The relative positioning of ground plane 312 to antenna plane 308 is further detailed in image 318, which shows a magnified view of a portion of computing device 300. As can be seen, antenna plane 308 and ground plane 312 are positioned generally parallel to one another, in a manner similar to antenna plane 202 and ground plane 204 of FIG. 2. Antenna plane 308 and ground plane 312 additionally include a space between them, indicated here as gap 320. Similar to gap 206 of FIG. 2, gap 320 represents an air gap, or dielectric spacer, with a predetermined distance or spacing between the two planes that enables a standing wave to form. Gap 320 can be any suitable distance, such as a length on the order of millimeters that ranges from a size greater than 0 mm up to generally 2.0 mm (e.g., 0.5 mm, 1.1 mm, 2.0 mm, 2.1 mm, etc.), a length on the order centimeters, and so forth. In some cases, the distance of gap 320 is defined based upon a design trade-off between a target resonant frequency, frequency bandwidth, and power efficiency versus a resultant size or height of computing device 300. Some embodiments fill gap 320 with a low-loss dielectric, a Teflon™ spacer, or other material to add structure and stability to computing device 300 without impeding wireless connectivity.

A portable computing device with multiple wireless capabilities adds more flexibility for a user than a device with only a single wireless capability. For instance, a user may desire a Bluetooth™ wireless link between external speakers and the portable computing device in order to control media playback. The user may also desire Internet connectivity through a WiFi connection, the ability to send Short Message Service (SMS) text messages, or communicate over a cellular network. Thus, various embodiments configure a single antenna to operate over a wide band of frequencies that spans from a low band frequency, such as 700 MHz, to a high band frequency, such as 2700 MHz. As previously discussed, various parameters associated with the size, shape, gap distance, gap material (e.g., air versus dielectric), ground shorting position, and feed position can be selected and applied to antenna plane 308 and ground plane 312 in order to configure computing device 300 to support wide frequency ranges. However, other parameters can affect the efficiency of an antenna of a portable computing device, particularly when it is worn by a user.

In order to communicate with one another and work in concert, various components contained within upper partition 302 and lower partition 304 are electrically connected, generally represented here as connection 322. In some cases, connection 322 comprises a cable or flex connector containing multiple various connections. Here, connection 322 connects to PCB 316 to display component 310, but other suitable connections can be used as well. Among other things, connection 322 establishes a pathway for communication between components, such as PCB 316 receiving touch input information generated from user interaction with display component 310 and/or PCB 316 driving display of content at display component 310. However, these electrical connections can impact or impede the operation of the antenna incorporated into computing device 300 (e.g. antenna plane 308 and ground plane 312). Accordingly, some embodiments place the corresponding ground connection or shorting pin between antenna plane 308 and ground plane 312 nominally coincident to connection 322 as a way to maintain the intended functionality of the antenna (e.g. target resonant frequency, target frequency bandwidth, etc.). Alternately or additionally, connection 322 can be used as the ground connection and/or shorting pin between the antenna plane and the ground plane.

This is further illustrated in image 324, which shows a magnified view of computing device 300 where connection 322 and antenna plane 308 meet. In image 324, antenna plane 308 is segmented with a first portion positioned on the left side of connection 322 and a second portion positioned on the right side of connection 322. Ground connection 326 electrically joins connection 322 with antenna plane 308 on the left side, while ground connection 328 electrically joins connection 322 with antenna plane 308 on the right side. The position of these ground connections, as well as the usage of connection 322 to establish a common ground, can impact how efficiently the antenna resonates, such as how efficiently it resonates at lower frequencies (e.g., 700-900 MHz).

Figure 4:
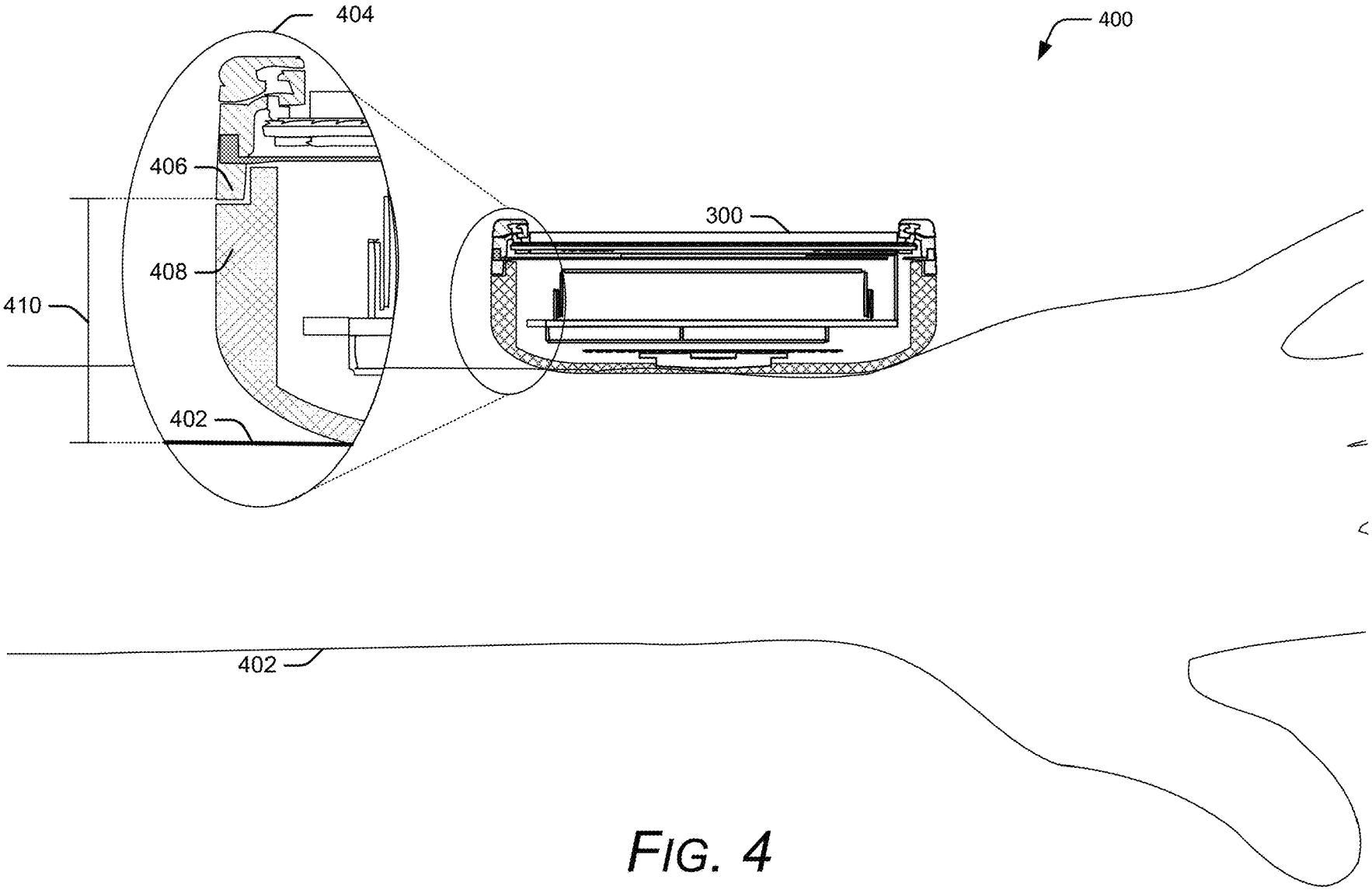
FIG. 4 illustrates an overview of a representative environment in accordance with one or more embodiments.

FIG. 4 illustrates environment 400 in which computing device 300 is being worn by a user. Here, computing device 300 is mounted to arm 402, but for simplicity's sake, this illustration does not include the device mount mechanism (e.g., wristbands). Image 404 shows an enlarged view of a portion of computing device 300 relative to arm 402. As discussed above, upper housing 406 (shaded using a diagonal striped shading pattern) includes the antenna plane of a PIFA (shaded using a solid grey pattern). Portions or all of upper housing 406 are constructed using a metal or other material suitable for supporting a standing wave current distribution. To enclose its various components, computing device also includes lower housing 408 (shaded using a cross-hatch pattern). Since lower housing 408 mounts to arm 402, it consists of a non-conductive or non-metal material, such as a plastic. When joined together, upper housing 406 and lower housing 408 create the overall structure of computing device 300. However, this presents various issues to be considered when designing the overall size of computing device 300.

Generally, users are more likely to wear a computing device with a smaller form or size than a computing device that is perceived as being heavy, bulky, large, or awkward. Thus, it is desirable to design a computing device that is perceived as being compact and light. When considering a computing device that is mounted to a user, the compact size can adversely affect an antenna's efficiency. Consider length 410, which represents the distance between the metal structure of upper housing 406 (which is connected to the device's antenna) and arm 402. As an antenna moves closer to arm 402, it dissipates more power (e.g., more waves are absorbed by the user). Conversely, as the distance increases between the antenna and the user, less power is dissipated or lost. Accordingly, if power dissipation were the only concern with respect to computing device 300, length 410 would ideally have a length that reduces or eliminates any power dissipation into arm 402. However, it is likely that such a length would generate a chassis size or height that is undesirable to a user. Thus, the selection of length 410 may not only be based on finding an optimal value that only focuses on power dissipation. Instead, the resultant distance for length 410 can be based upon balancing the opposing needs of reducing power dissipation into arm 402, while still maintaining an overall form factor or height of the housing structure of computing device 300 that is acceptable to a user. In other words, length 410 might represent a distance that is sub-optimal for power dissipation and/or sub-optimal for a desired user form factor, but adequately addresses both at the same time. Any suitable distance can be selected for length 410, such as a distance that generally ranges on the order of millimeters (e.g., 5 mm, 7 mm, 10 mm), a distance generally on the order of centimeters (cm) (e.g., 1 cm, 1.2 cm, 2 cm, etc.), and so forth. As in the case above, the term "generally" is used here to indicate that, due to real-world conditions, various embodiments deviate from being exactly 5 mm, 7 mm, 10 mm, etc., but are within a range that, when rounded to a nearest whole number, signify these values.

Some embodiments design the antenna of computing device 300 based upon an intended operating environment. Consider again FIG. 4 in which computing device 300 is mounted to a user's arm. When mounted and/or placed on a user's arm, the arm acts as an extended ground plane. In turn, this improves the antenna's radiation efficiency at lower frequencies, such as generally 700-900 MHz than when computing device 300 is not mounted to/unmounted from a user. Accordingly, computing device 300 can incorporate an antenna that is considered electrically small for these lower frequencies when unmounted to a user's arm, but have improved performance of an electrically larger antenna when mounted by the user.

Another parameter that can affect the operation, efficiency, and/or resonant frequencies of a PIFA is the construction of its corresponding antenna plane and/or ground plane. For example, consider antenna plane 308 of FIG. 3. As previously discussed, some embodiments electrically connect a front housing structure with a display bezel layer to create the antenna plane. In such a scenario, having a smooth and flat antenna plane helps establish the electromagnetic field between the antenna plane and the ground plane. However, electrically connecting and sealing these two pieces together can pose certain challenges when there are opposing design guidelines. From a mechanical standpoint, it is desirable to have fewer connections, while from an electrical standpoint, it is desirable to have many connections in order prevent energy from being trapped in the display layers. Thus, some embodiments find a balance between these opposing design guidelines by determining a number of electrical connections that is sufficient to connect and seal the two components to enable the antenna to operate over a desired range of frequencies and/or a target resonant frequency, but also reduces the number of connections to address the mechanical concerns. In some embodiments, the number of connection points is based upon a target resonant frequency, such as a value generated by $$\frac{\lambda}{8}, \frac{\lambda}{10},$$

etc., where $\lambda$ represents the highest operating frequency of the antenna. Thus, as in the case above, the selection of the number of connection points can be sub-optimal for mechanical purposes and/or sub-optimal for a target resonant frequency, but adequately addresses both at the same time such that the antenna remains operational.

By modifying various parameters of an antenna implementation, a portable computing device can inherently incorporate an antenna capable of wireless communications over a wide band of frequencies while decoupling the computing device from external components. This allows for additional benefits to the user. For example, in the case of a portable computing device in the form of a wrist-wearable watch, an antenna plane made from inherent components decouples the watch from its wristband. That is, when a wristband incorporates an antenna, the computing device is dependent upon that particular wristband in order to maintain a wireless link. This can prevent the user from additional flexibility, such as using more traditional materials for a wristband. Conversely, when the wristband is the decoupled from the operations of the watch (e.g., the antenna is not included or built into the wristband, and the wristband is decoupled from wireless communications performed by the watch and/or wireless communications the watch is designed to perform), the user has more control over the look and feel of the watch. A decoupled wristband can also affect the comfort of the watch. For instance, when a wristband incorporates an antenna, the hinge used to connect the wristband to the watch conforms to design needs that ensure the antenna radiates at desired frequencies and has an electric connection to the watch. This can compromise a user's comfort in wearing the hinge by affecting the corresponding shape. Conversely, when the wristband is decoupled from the watch, a hinge can be designed for comfort without the added design constraints associate of wristband that incorporates an antenna.

Another benefit to using inherent components of a portable computing device to construct the antenna plane of a PIFA relates to testing. In order to transmit wireless signals, the Federal Communications Commission (FCC) has various standards or tests outlined for devices to pass in order to be in compliance. Having all radiating elements contained within the body of the portable computing device simplifies the testing process by making the testing process more straightforward by eliminating multiple variations and combinations of antenna elements.

Incorporating a PIFA into a portable computing device also has a benefit related to the size and shape of the computing device. Relative to other antenna implementations, a PIFA has a smaller size for a same resonant frequency. Through careful design selections, parameters can be chosen to create an electrically small antenna. Here, the term "electrically small" is used to indicate that the volume/size of the antenna is smaller than its corresponding radian sphere based upon the radiating wavelength in free space. In turn, this helps reduce the size of devices incorporating the antenna.

Figure 5:
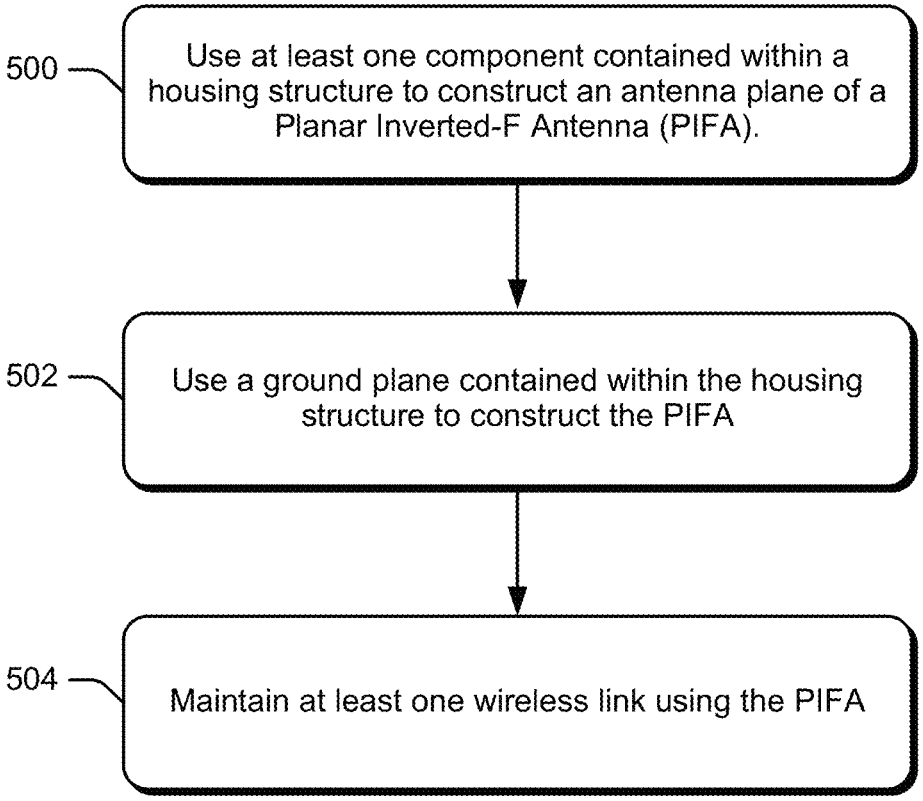
FIG. 5 illustrates an example flow diagram that describes a method that utilizes an antenna in a portable computing device in accordance with one or more embodiments.

FIG. 5 illustrates a flow chart that describes steps in a method in accordance with one or more embodiments. The method can be performed by any suitable hardware, software, firmware, or combination thereof. In at least some embodiments, aspects of the method can be implemented using portable computing device 102 of FIG. 1.

Step 500 uses at least one component contained within a housing structure of a portable computing device to construct an antenna plane of a PIFA. As further described above, some embodiments electrically connect a front housing structure contained within an upper partition of the housing structure with a display component to create the antenna plane. The portable computing device can be any suitable type of device, such as a wrist-wearable watch. The PIFA can be partially or entirely contained within the housing structure.

Step 502 uses a ground plane contained within the housing structure to construct the PIFA by positioning the ground plane generally parallel to the antenna plane. In some cases, the ground plane resides in a lower partition of the housing structure, where the lower partition and the upper partition join together to create the housing structure of the portable computing device. The structure of the PIFA can maintain a spatial gap between ground plane and the antenna plane, where the spatial gap can be an air-gap, can include a Teflon™ spacer, or any other suitable material. At times the spatial gap has a length associated with one or more resonant frequencies of the PIFA.

Step 504 maintains at least one wireless link between the portable computing device and another device using the PIFA to transmit and receive wireless signals (and, subsequently, transmitting and receiving information via the wireless signals). In some cases, the antenna transmits signals over a wide band of frequencies, such as a frequency range spanning from about and generally between 700 MHz up to 2700 MHz. Some embodiments maintain multiple wireless links, where each wireless link is implemented using a respective format and/or protocol, while other embodiments simply maintain a single format.

Having considered a discussion of an antenna configuration with respect to a portable computing device, consider now a discussion of an example device that can be utilized to implement the embodiments described above.

Example Device

Figure 6:
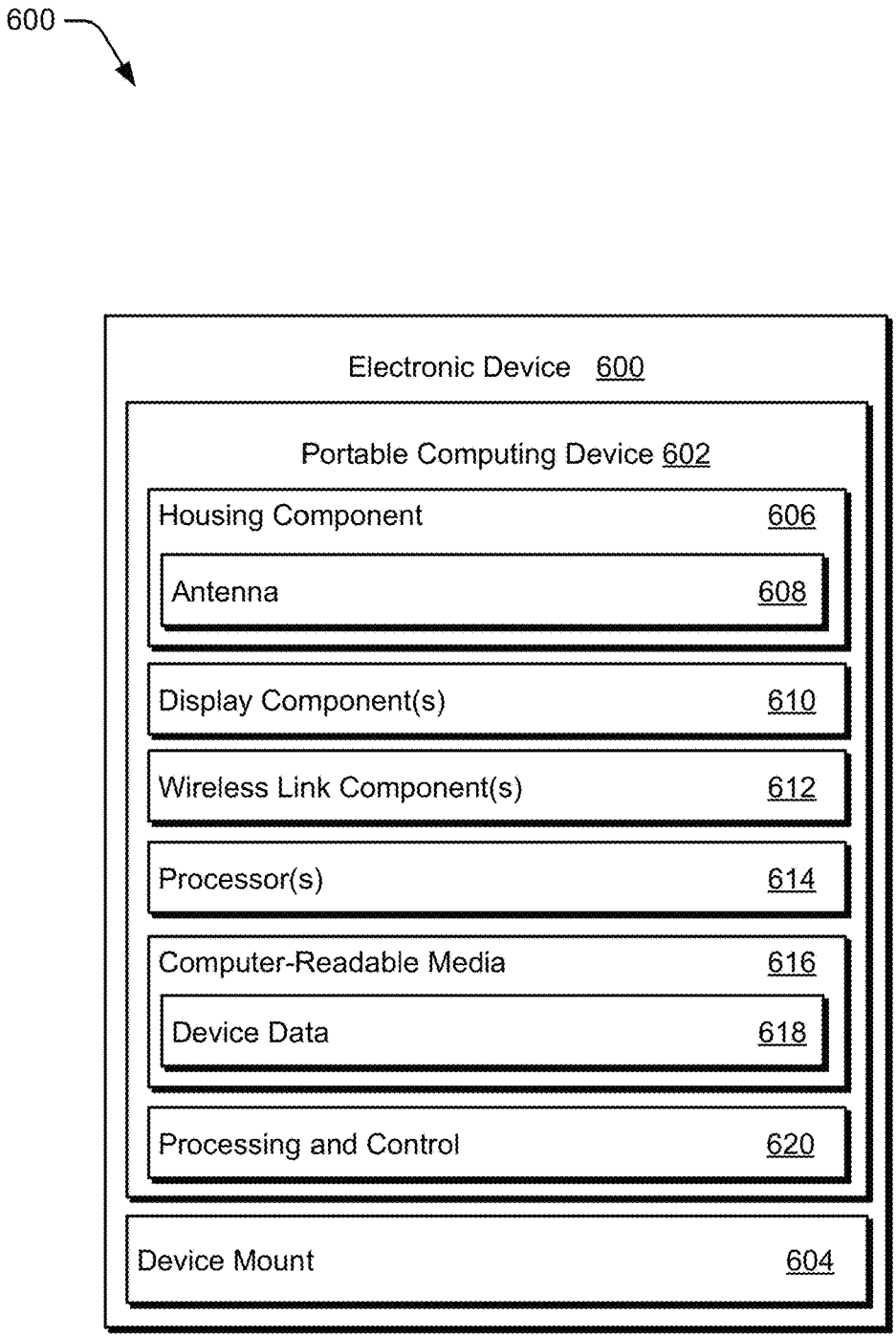
FIG. 6 is an illustration of a device in accordance with one or more embodiments.

FIG. 6 illustrates various components of an example electronic device 600 that can be utilized to implement the embodiments described herein. Electronic device 600 can be, or include, many different types of devices capable of transmitting over a wide band of frequencies using an internal antenna, such as portable computing device 102 of FIG. 1. In some embodiments, electronic device 600 is a wrist-wearable electronic device.

Electronic device 600 includes portable computing device 602 and device mount 604. Here, device mount 604 represents a mounting mechanism external to portable computing device 602 that can be used wear or mount portable computing device 602 to a person. While this example includes device mount 604, other embodiments omit device mount 604 or configure device mount 604 as being removable from electronic device 600, thus making device mount 604 optional to electronic device 600. Device mount 604 can be made of any suitable type of material, and have any suitable shape, examples of which are provided above.

Portable computing device 602 includes housing component 606 to house or enclose various components within the computing device. Housing component 606 can be a single solid piece, or be constructed from multiple pieces. In some embodiments, housing component 606 includes an upper partition and a lower partition that join together to form the housing component. The housing component can be constructed from any suitable material, such as metal, silicone, plastic, injection molding, and so forth. In the cases where housing component 606 is constructed from multiple pieces, each piece can be of a same material, or can incorporate different materials from one another.

Housing component 606 includes antenna 608. The inclusion of antenna 608 in housing component 606 indicates here that antenna 608 is at least partially constructed from housing component 606, examples of which are described herein. In some embodiments, antenna 608 is constructed using portions of housing component 606 and portions of various components, boards, or circuits that are enclosed or contained within the housing structure, such as display component 610. For example, in some embodiments, antenna 608 is a PIFA, where the antenna plane is inherently constructed using portions of housing component 606 and display component(s) 610, and the ground plane is constructed from various other components enclosed partially or fully within the housing component. Antenna(s) 608 receives an electrical signal generated by portable computing device 602, and propagates a corresponding electromagnetic wave. Similarly, antenna(s) 608 receives or detects electromagnetic waves propagating in free space, and converts these waves into corresponding electrical signals detectable by portable computing device 602.

Display component(s) 610 generally represent components used to display content to a user, and can include a display assembly and a display bezel. These display components can be partially or fully supported within housing component 606. In some cases, the display components enable a user to enter input to portable computing device 602 in order to direct its respective functionality, such as through a touch-screen interface.

Portable computing device 602 also includes wireless link component(s) 612 which are used here to generally represent hardware, software, firmware, or any combination thereof, that is used to establish, maintain, and communicate over a wireless link. Wireless link component(s) 612 work in conjunction with antenna 608 to send, receive, encode, and decode corresponding messages communicated via the wireless signals, and can be enclosed partially or fully within housing component 606. The wireless link components can be multipurpose (e.g., support multiple different types of wireless links) or can be single purpose. Portable computing device 602 can include multiple types of wireless link components to support multiple wireless communication paths, or simply include a set of wireless link components configured for a single wireless communication path.

Portable computing device 602 of this example includes processor(s) 614 (e.g., any of application processors, microprocessors, digital-signal processors, controllers, and the like) or a processor and memory system (e.g., implemented in a system-on-chip), which processes computer-executable instructions to control operation of the device. A processing system may be implemented at least partially in hardware, which can include components of an integrated circuit or on-chip system, digital-signal processor, application-specific integrated circuit, field-programmable gate array, a complex programmable logic device, and other implementations in silicon and other hardware.

Portable computing device 602 also includes computer-readable media 616 that enables data storage, examples of which include random access memory (RAM), non-volatile memory (e.g., read-only memory (ROM), flash memory, EPROM, EEPROM, etc.), and a disk storage device. Computer-readable media 616 is implemented at least in part as a physical device that stores information (e.g., digital or analog values) in storage media, which does not include propagating signals or waveforms. The storage media may be implemented as any suitable types of media such as electronic, magnetic, optic, mechanical, quantum, atomic, and so on. Computer-readable media 616 provides data storage mechanisms to store device data 618. Here, device data 618 is used to generally represent data, executable instructions that can be processed by processor(s) 614, or any other type of information that is storable.

Alternatively, or in addition, the electronic device can be implemented with any one or combination of software, hardware, firmware, or fixed-logic circuitry that is implemented in connection with processing and control circuits, which are generally identified at 620 (processing and control 620). Although not shown, portable computing device 602 can include a system bus, crossbar, interlink, or data-transfer system that couples the various components within the device. A system bus can include any one or combination of different bus structures, such as a memory bus or memory controller, data protocol/format converter, a peripheral bus, a universal serial bus, a processor bus, or local bus that utilizes any of a variety of bus architectures.

It is to be appreciated that while electronic device 600 includes distinct components, this is merely for illustrative purposes, and is not intended to be limiting. For example, some embodiment may exclude various components listed in electronic device 600. In view of the many possible embodiments to which the principles of the present discussion may be applied, it should be recognized that the embodiments described herein with respect to the drawing figures are meant to be illustrative only and should not be taken as limiting the scope of the claims. Therefore, the techniques as described herein contemplate all such embodiments as may come within the scope of the following claims and equivalents thereof.

We claim:

1. A device, comprising:

a flat metal surface of a display configured as an antenna plane of a Planar Inverted-F Antenna (PIFA), the flat metal surface of the display included within a housing structure of the device;

a ground plane included within the housing structure and positioned substantially parallel to the antenna plane to form the PIFA; and a ground connection between the antenna plane and the ground plane configured to ground the PIFA.

2. The device of claim 1, further comprising a wireless component to maintain at least one wireless link between the device and another device using the PIFA.

3. The device of claim 2, wherein, to maintain the at least one wireless link, the wireless component is configured to:

transmit, with the PIFA, wireless signals over the at least one wireless link in a frequency range from 700 Megahertz (MHz) to 2700 MHz; and receive, with the PIFA, additional wireless signals over the at least one wireless link in the frequency range.

4. The device of claim 1, wherein a spatial gap is maintained between the antenna plane and the ground plane.

5. The device of claim 4, wherein the spatial gap is configured based on a target resonant frequency of the PIFA.

6. The device of claim 1, further comprising a feed connection between the antenna plane and the ground plane to drive the PIFA with a signal to radiate.

7. The device of claim 1, further comprising an outer ring of the housing structure electrically connected to the flat metal surface via electrical connections.

8. The device of claim 7, wherein a number of the electrical connections is based on a highest operating frequency associated with the PIFA.

9. The device of claim 1, wherein the flat metal surface of the display configured as the antenna plane of the PIFA includes a bottom surface of a display bezel of the housing structure.

10. A device, comprising:

a flat metal surface of a display included within the device as an antenna plane of a Planar Inverted-F Antenna (PIFA); and a ground plane included within the device, the ground plane positioned generally parallel to the antenna plane and electrically connected to the antenna plane to ground the PIFA.

11. The device of claim 10, further comprising a wireless component to maintain at least one wireless link between the device and another device, the PIFA configured for transmitting and receiving wireless signals associated with the at least one wireless link.

12. The device of claim 11, wherein the transmitting the wireless signals associated with the at least one wireless link includes driving a feed connection between the antenna plane and the ground plane with the wireless signals.

13. The device of claim 10, wherein a spatial gap is maintained between the antenna plane and the ground plane, the spatial gap based on a target resonant frequency of the PIFA.

14. The device of claim 10, wherein the flat metal surface of the display is electrically joined to an outer ring of the device without incorporating a separate antenna.

15. The device of claim 14, wherein the flat metal surface of the display is electrically joined by the outer ring connected to the flat metal surface with a number of electrical connections based on a highest operating frequency associated with the PIFA.

16. The device of claim 10, wherein the ground plane is configured as metal components positioned below a top surface of a battery included in the device.

17. A device, comprising:

a flat metal surface of a display included within the device to form an antenna plane of a Planar Inverted-F Antenna (PIFA);

a ground plane included within the device and positioned generally parallel to the antenna plane to form the PIFA; and a wireless component to maintain at least one wireless link between the device and another device using the PIFA to communicate wireless signals associated with the at least one wireless link.

18. The device of claim 17, further comprising a ground connection between the antenna plane and the ground plane configured to ground the PIFA.

19. The device of claim 17, wherein the flat metal surface of the display usable as the antenna plane of the PIFA includes a bottom surface of a display bezel of the device.

20. The device of claim 17, wherein, to maintain the at least one wireless link, the wireless component is configured to at least one of transmit or receive the wireless signals over the at least one wireless link in a frequency range from 700 Megahertz (MHz) to 2700 MHz.

* * * * *